US005800156A

United States Patent [19]

Kahlke et al.

[11] Patent Number: 5,800,156

[45] Date of Patent: Sep. 1, 1998

[54] RADIANT BURNER WITH A GAS-PERMEABLE BURNER PLATE

[75] Inventors: Michael Kahlke, Bingen, Germany; Kenneth M. Kratsch, San Clemente, Calif.

[73] Assignee: Schott-Glaswerke, Mainz, Germany

[21] Appl. No.: 572,791

[22] Filed: Dec. 15, 1995

[30] Foreign Application Priority Data

Dec. 20, 1994 [DE] Germany ..... 44 45 426.0

[51] Int. Cl.[6] ..... F23D 14/12

[52] U.S. Cl. ..... 431/328

[58] Field of Search ..... 431/328, 329

[56] References Cited

U.S. PATENT DOCUMENTS

| | | | |
|---|---|---|---|
| 2,194,208 | 3/1940 | Moran | 431/328 |
| 3,843,313 | 10/1974 | Helgeson | 431/329 |
| 4,608,012 | 8/1986 | Cooper . | |
| 4,869,664 | 9/1989 | Wright et al. | 431/328 |
| 5,088,919 | 2/1992 | De Bruyne et al. . | |

FOREIGN PATENT DOCUMENTS

| | | |
|---|---|---|
| 0390255 | 3/1989 | European Pat. Off. . |
| 0549476 | 6/1993 | European Pat. Off. . |
| 2222329 | 10/1974 | France . |
| 2254689 | 10/1992 | United Kingdom . |

*Primary Examiner*—Carroll B. Dority
*Attorney, Agent, or Firm*—Felfe & Lynch

[57] ABSTRACT

Disclosed is a radiant burner with a burner chamber and a gas-permeable burner plate made of ceramic or metal, especially for cooking areas or individual cooking locations, the heating surface of which is composed of glass ceramic, the gas-permeable burner plate having regions of different gas permeability.

1 Claim, 2 Drawing Sheets

RADIANT BURNER WITH A GAS-PERMEABLE BURNER PLATE

BACKGROUND OF THE INVENTION

The invention relates to a radiant burner with a burner chamber and a gas-permeable burner plate made of ceramic or metal for gas appliances, especially for cooking areas or individual cooking locations, the heating surface of which is composed of glass ceramic.

Gas radiant burners for cooking appliances are known. Thus, for example, German Patent DE 24 40 701 C3 describes a gas stove with a plurality of cooking-location burners which are designed as gas radiant burners with perforated ceramic plates at the top surface of which the gas bums without a flame. These burners are arranged at a distance underneath a glass-ceramic plate common to all the burners. The space surrounding the burners is here closed on all sides except for openings situated outside the glass-ceramic plate and away form the operating side of the gas stove for carrying away the combustion gases, and each burner has an ignition device that can be actuated from outside and a safety pilot to safeguard against the outflow of unburnt gas. The invention of DE 24 40 701 C3 is characterized in that a small distance of about 10 mm to 15 mm is chosen between the glass-ceramic plate and the radiant surface of each burner ceramic plate, that each burner is divided into at least two chambers and that each of these chambers is equipped with a gas jet pump which draws in the combustion air.

The object of DE 24 40 701 C3 is to provide a gas stove which has a high efficiency and nevertheless offers good control with regard to differences in the heat requirement while maintaining this high efficiency.

U.S. Pat. No. 4,673,349 discloses gas radiant burners with burner plates made of porous ceramic which have a void volume of more than 30% by volume and a mean void diameter of 25–500 μm. These burner plates furthermore have a multiplicity of through passages, spaced apart at 2–30 mm, with hydraulic diameters of 0.05–5.0 mm running perpendicular to the combustion surface. The porous ceramic is here composed especially of a composite material, which can contain 2–50% by weight of heat-resistant inorganic, in particular ceramic, fibres.

A heating device with a gas burner which has two combustion chambers that can be supplied independently with gas and which can, for example, delimit mutually concentric zones in the region of the cooking zones is described in U.S. Pat. No. 4,083,355.

German Patent DE 40 22 846 C2 relates to a device for controlling and limiting output in the case of a glass-ceramic heating surface, in particular a cooking area, having at least one heating zone with a heating device comprising at least two heating elements that are arranged concentrically to one another, can be switched and controlled independently and delimit associated mutually concentric regions in the heating zone, having at least one annular, concentric glass-ceramic temperature measuring resistor, delimited in the glass-ceramic heat surface by parallel conductor tracks, in each heating-zone region assigned to a heating element, and having control and regulating devices in operative connection with the glass-ceramic temperature measuring resistors—each assigned to one heating region—for controlling and limiting the energy supply to the respectively associated heating element. The object of DE 40 22 846 C2 is to permit adaptation of the energy supply to the local differences in heat absorption in addition to reliable temperature monitoring over as much of the surface as possible.

According to the prior art, porous perforated ceramic plates or ceramic or metal fiber braids are used as burner plates. These burner plates close off at the top the mixing or burner chamber in which the gas/air mixture is added. In the uppermost layer of the burner plate, small flames burn and these cause the burner plates to glow and to act as radiant heaters. The temperature of the radiant burner plates is between about 900°–950° C.

Similar gas radiant burners are also employed in room heating, in hot water apparatuses and in drying systems. In general, the entire surface of the burner plate is made to glow; only in the case of dual-circuit burners are an inner circular disc and an outer annular burner operated separately.

The disadvantage of the current designs is that the output is uniformly distributed over the entire burner plate or, if the burner is designed as a dual-circuit burner with separate burners and/or a plurality of combustion chambers, that the design is complex and expensive and can furthermore likewise only be controlled in a very approximate fashion, in wide ranges.

It is advantageous in practice to lower the specific output in the center of the burner since otherwise there is a sharp rise in temperature in the middle of the burner in operation. The cooking utensils which are used in practice rest on the edge of their base and arch upwards in the middle of the base, giving rise to a thin cushion of air. Due to this cushion of air, the absorption of heat in the center is less than at the edge and a temperature peak occurs if the distribution of the output of the burner is uniform. In the case of heating elements for electrically operated cooking zones, the burner output in the center is for this reason lowered in comparison with the mean specific output.

It is therefore the object of the invention to provide a gas radiant burner which is safe to use and which, with the same total output and with a simple construction, requires a shorter heat-up period before the glowing regions of the burner plate first become visible, in combination, at the same time, with a significantly brighter glow pattern, and which provides better temperature distribution that can be adapted very finely and individually to the environment of the appliance, especially to the cooking situation and the cooking utensils.

Further objects of the invention are to ensure that waste from the expensive burner-plate material is as minimal as possible and to provide customer-specific embodiments of the burner plate and design requests.

The various features of novelty which characterizes the invention are pointed out with particularity in the claims annexed to and forming a part of this specification. For a better understanding of the invention, its operating advantages and specific objects obtained by its use, and reference should be had to the accompanying drawings and descriptive matter in which there is illustrated and described a preferred embodiment of the invention.

DESCRIPTION OF THE PREFERRED EMBODIMENT

Figure 1A:
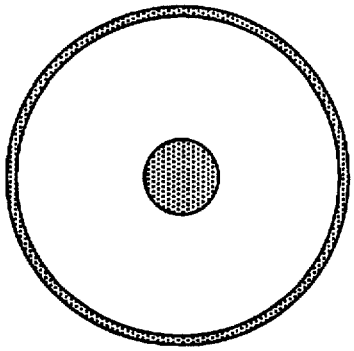
FIGS. 1*a*–1*d* show a number of embodiments of the invention.

The object of the invention is achieved by virtue of the fact that the gas-permeable burner plate has regions of different gas permeability, and, in a preferred embodiment, some areas of the burner plate are impermeable to gas. Preferably the gas-permeable burner plate is made of ceramic or metal.

In order to provide a particularly effective manner of achieving the object of the invention, namely the need for only a very short heat-up period before the glowing regions of the burner plate first become visible, the gas-impermeable regions should constitute 40% to 70%, in particular 50% to 60%, of the total area of the burner plate, the total output of the burner remaining at the same level even given the regions of different, reduced or zero gas permeability and the resultant reduction in output in these regions.

The regions of the burner plate of different gas permeability can be designed as circular or annular zones arranged concentrically to one another, as sections of a circle or sectors and/or segments or, alternatively, are of spiral design.

The burner plate is in one, monolithic piece or can be composed of a one-piece fiber mat, and the regions of different gas permeability should be assigned one material but with different properties such as, in particular, a different density and porosity.

The burner plates made of fiber materials can, for example, be compacted in part areas in such a way that gas no longer flows through at these points and this region becomes inactive.

In a preferred embodiment of the invention, the burner plate is made up of a plurality of individual discrete regions and/or zones and/or sectors. The burner plates are then composed, for example, of segments which are mounted in a mask. This construction enables the burner-plate material to be used at a particularly economical cost.

Round burner plates made of metal or ceramic fibers have namely hitherto been cut or punched out of large rectangular plates of such material. Naturally, this gives rise to waste, something which is particularly undesirable in the case of this expensive material. However, if the burner plates are formed of segments, the waste can be reduced or even completely avoided.

However, it is also possible for the regions of the burner plate of different gas permeability to be assigned regions of different materials. Thus, the gas-permeable regions of the burner plate can, for example, be in the form of sectors made of fiber materials, especially SiC fibers, and for the regions which have a zero gas permeability to be composed of impermeable $Al_2O_3$ or cordierite segments. The segments of different materials are then assembled and, for example, mounted in a mask.

In all the embodiments considered thus far, the regions of different gas permeability are the result of chemical and/or physical differences in the material properties of the burner plate itself, which is monolithic or built up from a plurality of individual regions. However, it is also possible for the regions of different gas permeability to be formed by a second material arranged on and/or underneath and/or in the completely or partially gas-permeable burner plate and having a gas permeability different from that of the burner plate. The second material can be a different material, especially $Al_2O_3$, or the same material, especially SiC with different density or porosity properties from the burner plate itself.

It is also possible for the regions of different gas permeability to be formed by coating them with a temperature-stable, gas-impermeable material, especially with finely particulate $Al_2O_3$ on the top and/or bottom side of the burner plate, or to be formed by masks, covers or glued-down portions of reduced or zero gas permeability, made, in particular, of high-grade steel sheet, which are positioned on the top and/or bottom side and/or sandwich-fashion in the burner plate.

In a particularly preferred embodiment, masks, in particular, are arranged in such a way that they can be changed and exchanged from the outside of the appliance during the operation of the burner plate.

Accordingly to the present invention, it is possible to separate the regions of different gas permeability of the burner plate discretely and sharply from one another or to have them merge continuously into one another and thus achieve a more gentle profile of the temperature distribution. The gas radiant burners according to the invention are particularly efficient in fulfilling their tasks if the gas-permeable burner plate is composed of porous ceramic, of ceramic, temperature-stable fibers, especially of SiC fibers, and/or of metallic fibers. The heating surface of the burner plate is preferably composed of glass ceramic. The invention is explained in greater detail below with reference to the figures and the exemplary embodiments.

FIG. 1 shows preferred embodiments of the covered burner plate. FIG. 1*b* and *d* show burners with radial circular sectors with an essentially constant temperature profile in the radial direction, the central area being recessed in FIG. 1*d*. In FIG. 1*c*, the burner is divided into circular rings, allowing the radial temperature profile to be defined by selection of the ratio of the areas of the covered regions to the open regions. In the case of the burner plate in accordance with FIG. 1*a*, only the central region is recessed, as is customary with electric heating elements.

Figure 1B:
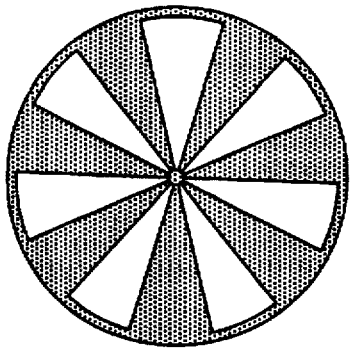
Figure 1C:
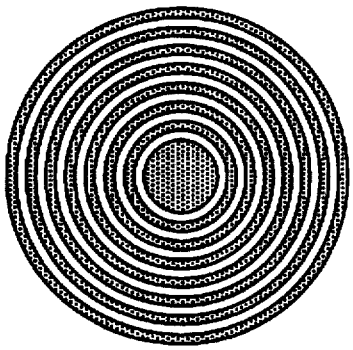
Figure 1D:
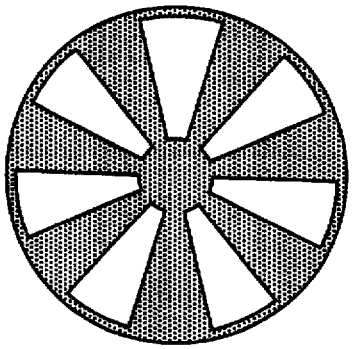

A burner plate such as that sold, for example, by Global Environmental Solutions, San Clemente, Calif., comprising SiC fibers (Nicalon, Nippon Carbide) with a thickness of 15 μm which are boned with SiC by chemical vapor deposition to give a shaped body, is coated over 60% of its area in accordance with FIG. 1*b*. The burner plate has a thickness of 4 mm, a diameter of 180 mm and a porosity of 90%. On the top side, which glows in operation, the regions which are to be covered are coated with aluminum oxide paste (901 Alumina Ceramic, Cotronics Corp., Brooklyn, N.Y.). Burner plates in accordance with FIGS. 1*a*, *c* and *d* are produced in the same way.

A rectangular SiC fiber mat produced as explained above is cut up in accordance with FIG. 2 with only a small amount of lost material at the edge. This can be done by means of blades or punching tools. The segments are mounted in such a way in rings of special-steel sheet (Type 104301) with a thickness of 2 mm that a burner with the shape shown in FIG. 1*a* is obtained. Adequate sealing in the region of the edge is achieved by means of the pressure and obvious additional flame regions thus do not occur.

The advantages of the invention include:

a temperature profile on the burner plate that can be set precisely to the requirements;

a simple and reliable construction;

immediate recognition of the operating state of the appliance by virtue of glowing regions which respond very rapidly;

a very bright glow pattern;

increased user safety;

lower gas consumption;

less waste from the expensive burner-plate materials; and customer-specific embodiments of the burner-plate configuration.

Referring to FIGS. 1*a* to 1*d* and 2*a* to 2*c*, various proposals are made for the application of a segmented burner plate. The areas 3 are the areas which are covered by means of a coating and, thus, are impermeable to the gas/air mixture. The areas 4 are not coated and, therefore, are permeable to the gas/air mixture. In these areas, the fiber fleece glows and emits IR radiation.

With this possibility of the targeted covering of different areas without having to change the basic material in its composition and its physical properties, different patterns of the flowing surface can, thus, be produced. Moreover, different temperature profiles can be produced, which can be designed so that, for example, in cooking equipment, the temperature distribution can be optimized for the bottom of the pot and, thus, a better utilization of energy can be achieved.

Figure 2A:
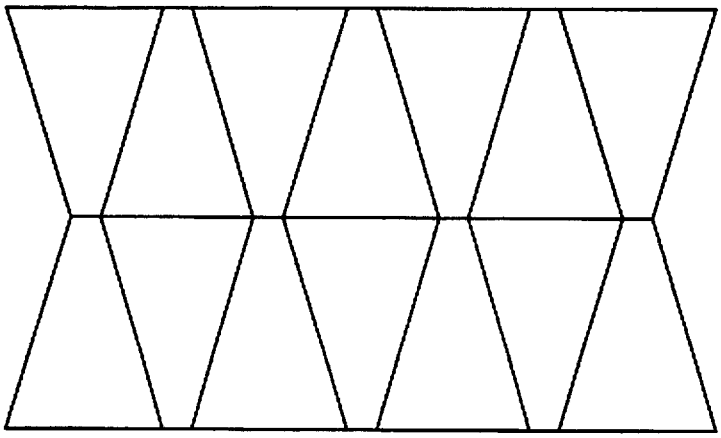
FIGS. 2*a* to 2*c* show cut up fiber mats.
Figure 2C:
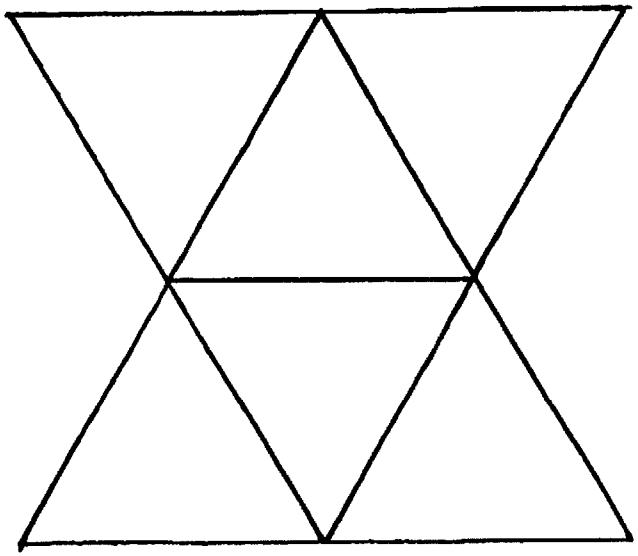
Figure 2B:
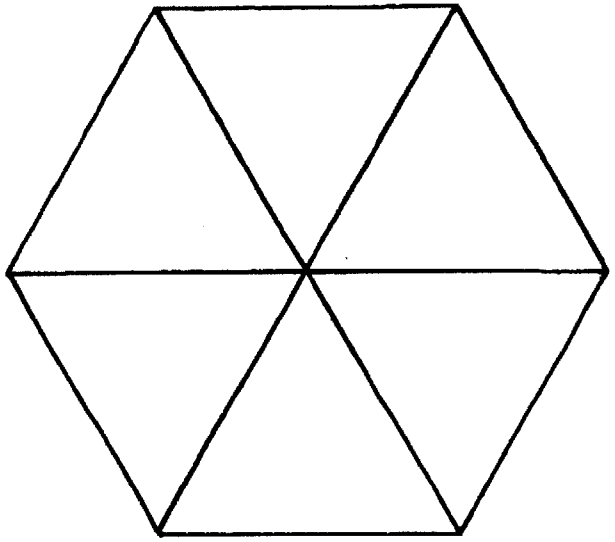

Combinations of equal areas on a burner are represented in FIGS. 2*a* to 2*c*. By the appropriate selection of the geometries, different burner surfaces, e.g., round, oval, polygonal, etc., can be produced. A complicated change of tools to change the forms is, thus, unnecessary.

Figure 3:
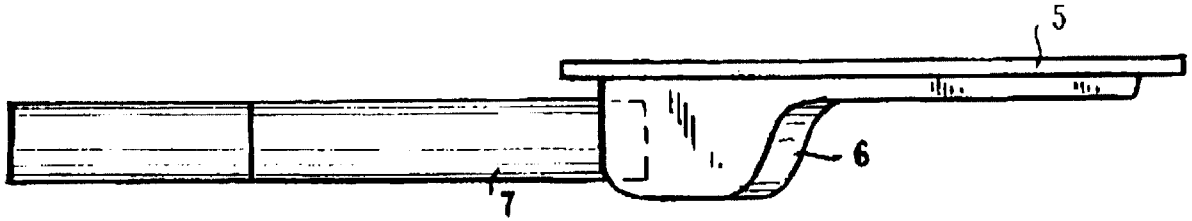
FIG. 3 shows a burner having an arrangement of the burner plate of the invention on a burner chamber.

Referring to FIG. 3, shown is a burner 10 having a mixing tube a combination of a burner, burner chamber, and plate in the present invention. The burner plate 5 is fixed to a structure which contains a burner chamber 6. Also illustrated is a mixing tube which protrudes into the burner chamber.

It will be understood that the specification and examples are illustrative but not limitative of the present invention and that other embodiments within the spirit and scope of the invention will suggest themselves to those skilled in the art.

We claim:

1. A radiant burner for gas appliances comprising: a burner chamber; and a gas-permeable burner plate made of ceramic and having a heating surface composed of glass ceramic wherein the gas-permeable burner plate has regions of different gas permeability for providing regions of different temperature distribution, wherein the regions of the burner plate of different gas permeability are circular or annular zones arranged concentrically to one another or are of spiral design.

* * * * *